US009915237B2

(12) United States Patent
Borkowski

(10) Patent No.: US 9,915,237 B2
(45) Date of Patent: Mar. 13, 2018

(54) COMBINATION SHUTTLE AND LUBRICATOR VALVE FOR AN AIR STARTER

(71) Applicant: Ingersoll-Rand Company, Davidson, NC (US)

(72) Inventor: Michael R. Borkowski, Concord, NC (US)

(73) Assignee: Ingersoll-Rand Company, Davidson, NC (US)

( * ) Notice: Subject to any disclaimer, the term of this patent is extended or adjusted under 35 U.S.C. 154(b) by 261 days.

(21) Appl. No.: 14/967,509

(22) Filed: Dec. 14, 2015

(65) Prior Publication Data

US 2016/0186710 A1 Jun. 30, 2016

Related U.S. Application Data

(60) Provisional application No. 62/098,835, filed on Dec. 31, 2014.

(51) Int. Cl.

| | |
|---|---|
| ***F02N 7/12*** | (2006.01) |
| ***F01M 11/02*** | (2006.01) |
| ***F01M 7/00*** | (2006.01) |
| ***F02N 7/10*** | (2006.01) |

(52) U.S. Cl.

CPC ..... *F02N 7/12* (2013.01); *F01M 7/00* (2013.01); *F01M 11/02* (2013.01); *F02N 7/10* (2013.01)

(58) Field of Classification Search

CPC .... F02N 7/12; F02N 7/08; F02N 7/10; F01M 11/00; F01M 5/02; F01M 5/025; F01M 2005/028; F01M 9/04; F01M 7/00; F16N 7/30; F16N 7/36

USPC ..... 184/6.3

See application file for complete search history.

(56) References Cited

U.S. PATENT DOCUMENTS

| | | | | |
|---|---|---|---|---|
| 3,129,788 | A | 4/1964 | Heckt | |
| 3,489,246 | A | 1/1970 | Barger | |
| 3,595,342 | A * | 7/1971 | O'Leary | F16N 7/34 184/39.1 |
| 3,722,209 | A | 3/1973 | Kaytor | |
| 3,816,040 | A | 6/1974 | Janik | |
| 4,170,210 | A | 10/1979 | Janik, Jr. | |
| 4,993,516 | A * | 2/1991 | Taiani | F16N 7/30 184/41 |
| 5,542,384 | A * | 8/1996 | Rosenmann | F02N 7/08 123/179.31 |
| 7,900,748 | B2 | 3/2011 | Bukhari et al. | |

* cited by examiner

*Primary Examiner* — William E Dondero
*Assistant Examiner* — Robert T Reese
(74) *Attorney, Agent, or Firm* — Taft Stettinius & Hollister, LLP

(57) ABSTRACT

A system for starting an engine is disclosed herein. The system includes a combination valve to control compressed fluid flow and lubricant flow to an air starter. The combination valve includes a housing having a shuttle valve and a lubricator valve disposed therein. The shuttle valve controls a compressed fluid flow and the lubricator valve controls a lubricant flow to the air starter.

29 Claims, 3 Drawing Sheets

COMBINATION SHUTTLE AND LUBRICATOR VALVE FOR AN AIR STARTER

CROSS REFERENCE TO RELATED APPLICATIONS

This application claims the benefit of U.S. Provisional Application No. 62/098,835, filed Dec. 31, 2014, which is incorporated herein by reference in its entirety.

TECHNICAL FIELD

The present application generally relates to a combination shuttle and lubricator valve and more particularly, but not exclusively to a combination shuttle and lubricator valve for an air starter driven by compressed fluid.

BACKGROUND

Air starters can be used to start engines such as for example diesel, spark ignited or gas turbine engines. Air starters use compressed fluid such as air to rotatingly drive a vaned rotor which in turn is connected via one or more gears to an engine ring gear or starter gear. Some air starters require lubricant to be added to the compressed air to lubricate portions of the rotor. Some existing systems have various shortcomings relative to certain applications. Accordingly, there remains a need for further contributions in this area of technology.

SUMMARY

One embodiment of the present application is a unique combination shuttle and lubricator valve for an air starter system. Other embodiments include apparatuses, systems, devices, hardware, methods, and combinations for compressor systems with a unique combination shuttle and lubricator valve for use with an air starter. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
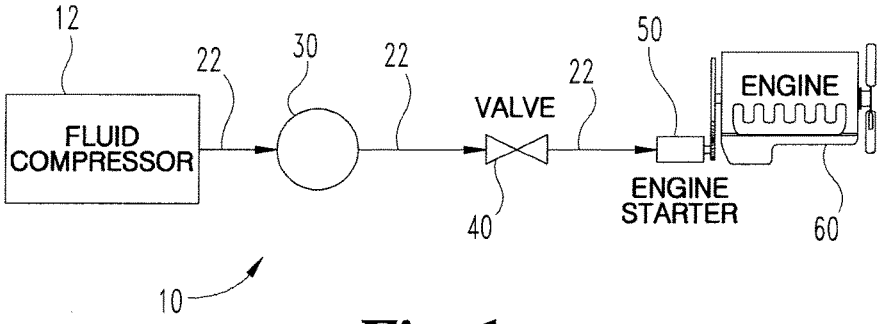
FIG. 1 is a schematic view of an exemplary engine starter system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Engine starter systems driven by compressed fluid can be used to start a variety of types and sizes of engines. These engines can include internal combustion engines or gas turbine engines used for a variety of applications such as, for example large commercial vehicles, industrial facilities or water based vessels. Engine size is not limited with the starter system disclosed in the present application and can range from tens to thousands of horsepower. The term "fluid" should be understood to include any gas or liquid medium that can be used in the compressor system as disclosed herein. It should also be understood that air is a typical working fluid, but different fluids or mixtures of fluid constituents can vary and still remain within the teachings of the present disclosure, therefore terms such as fluid, air, compressible gas, etc., can be used interchangeably and remain within the scope of the patent application. For example, in some embodiments it is contemplated that a hydrocarbon gaseous fuel such as natural gas or propane could be used as a primary working fluid.

Referring now to FIG. 1, a portion of an engine starter system 10 is illustrated in schematic form. A compressed working fluid illustrated by arrow 22 can be generated by a fluid compressor 12 to a desired flow rate and pressure. The compressed working fluid 22 can include various constituencies including air, water, oil, or other desirable constituents and/or undesirable contaminants. The engine starter system 10 can include an optional compressed fluid storage tank 30 in certain applications. The compressed working fluid 22 then enters a combination shuttle and lubricator valve 40 configured to control a compressed fluid flow rate and a quantity of lubricant injected into the compressed fluid 22. An engine starter 50 is configured to receive a compressed fluid flow with a mixture of lubricant controlled by the combination valve 40. The engine starter 50 will then rotate an engine 60 to a starting rotational speed.

Figure 2:
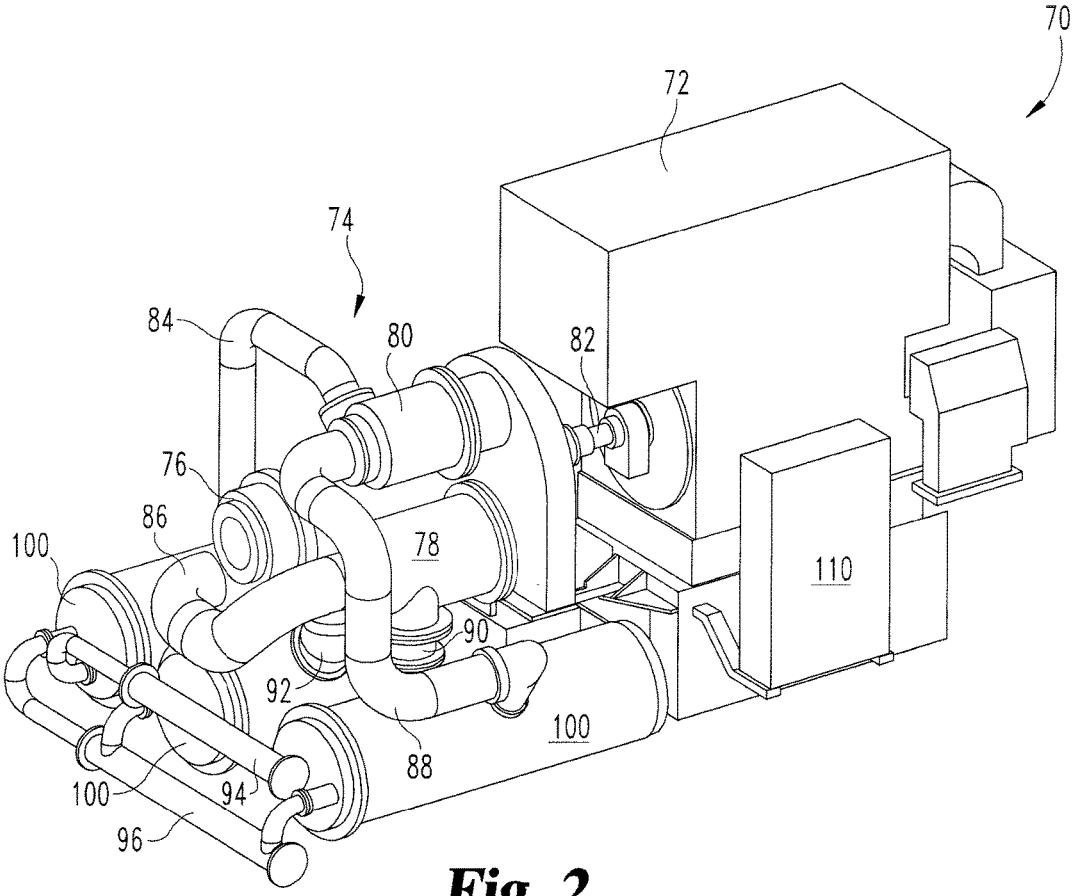
FIG. 2 is a perspective view of an exemplary compressor system that may be used in one embodiment of the present disclosure.

Referring now to FIG. 2, an exemplary compressor system 70 can be used with an engine starter system as defined in the present application. The compressor system 70 includes a primary motive source 72 such as an electric motor, an internal combustion engine or a fluid-driven turbine and the like. The compressor system 70 can include a compressor 74 with multi-stage compression and in the exemplary embodiment includes a first stage compressor 76, a second stage compressor 78, and a third stage compressor 80. In other embodiments a different number of compressor stages may be employed with the compressor 70. The compressor 70 can include centrifugal, axial and/or positive displacement compression means. The primary motive source 72 is operable for driving the compressor 70 via a drive shaft 82 to compress fluids such as air, natural gas, propane or the like.

Portions of the compressed air discharged from the compressor 74 can be transported through more one or more conduits 84, 86, 88, 90 and 92 to one or more intercoolers 100 and/or to another compressor stage. An inlet fluid manifold 94 and an outlet fluid manifold 96 can be fluidly connected to the intercoolers 100 to provide cooling fluid such as water or other liquid coolant to cool the compressed air after discharge from one or more of the compressor stages of the compressor 74. The compressor system 70 can also include a controller 110 operable for controlling the primary motive power source and various valving and fluid control mechanisms (not shown) between the compressor 74 and intercoolers 100. The compressor system of FIG. 1 is only one exemplary form of a compressor system that can be used with the teachings of the present disclosure. Other forms and configurations are also contemplated herein. For example, portable compressor systems or compressor systems that are mounted onto industrial engines, land vehicle engines, or water vessels can be used with the engine starter system described herein.

Figure 3:
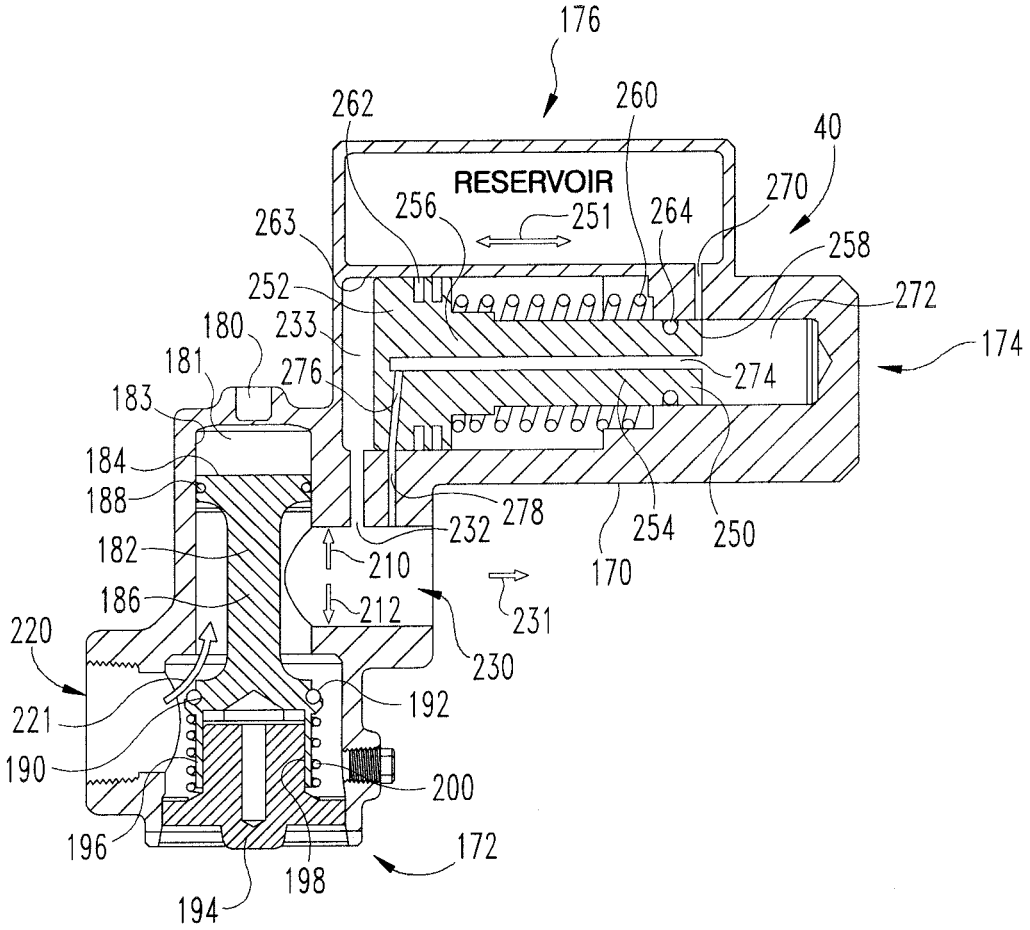
FIG. 3 is a cross sectional view of a combination valve shown with a shuttle valve piston in an open position.
Figure 4:
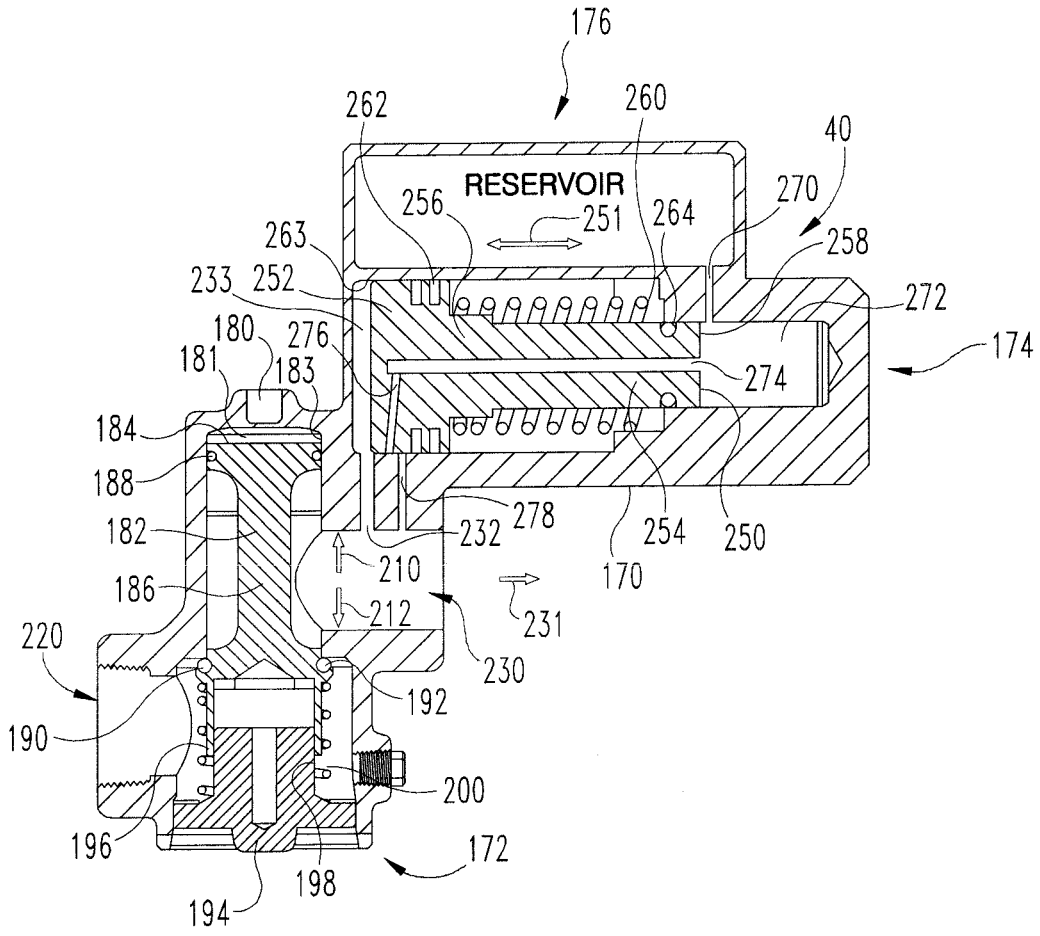
FIG. 4 is a cross-sectional view of the combination valve of FIG. 3 with the shuttle valve piston in a closed position.

Referring now to FIGS. 3 and 4, the combination shuttle and lubricator valve 40 is illustrated in cross sectional form. The combination valve 40 includes a single integral housing 170 with a shuttle valve 172, a lubricator valve 174 and a lubricant reservoir 176 disposed therein. In some forms the housing 170 can be a single piece integrally formed structure made from a casting or machined billet or the like. Other forms can include one or more portions of the housing 170 that are removably coupled to other portions such as through the threaded fastening means or other mechanical joining means including welding, brazing, gluing, or press fit etc. Also, in some forms the lubricant reservoir 176 may be separate from the integral housing 170 and not associated with the combination shuttle and lubricator valve 40.

The shuttle valve 172 can include a signal air inlet 180 positioned so as to permit a compressed fluid such as air or the like to be received within a cylinder cavity 181 of the shuttle valve 172. The cylinder cavity 181 is configured to slidingly receive a shuttle valve piston 182 therein. The shuttle valve piston 182 can include a shuttle valve piston head 184 connected to a stem 186 at one end thereof. One or more seals 188 formed by a metal rings or compliant seal rings can be engaged with the piston head 184 to seal against side walls 183 of the cylinder cavity 181. The signal air flows into the cylinder cavity 181 at a pressure sufficient to generate a force on the shuttle valve piston head 184 to move the shuttle piston 184 in a downward direction. A shuttle valve piston foot 190 can extend from the other end of the shuttle valve stem 186 of the shuttle valve piston 182. A seal 192 can be engaged with the piston foot 190 so as to selectively seal with the portions of the sidewalls 183 of the cylinder cavity 181 as will be described in more detail below.

A shuttle valve support base 194 is positioned to support the shuttle valve piston 182 as the piston moves between a first position shown in FIG. 4 corresponding to a closed position and a second position corresponding to an open position shown in FIG. 3. A foot extension 196 is operable for slidingly engaging along an upright sidewall 198 of the support base as the shuttle valve piston 182 slides between the first and second positions. A resilient member 200 such as a coil spring or the like is configured to urge the shuttle valve piston 182 toward the closed position shown in FIG. 4.

The shuttle valve 172 includes an inlet 220 that receives fluid from a compressed fluid source and an outlet 230 that directs compressed fluid past the piston 182 as illustrated by arrow 221 when the piston is in the second position as shown in FIG. 3. The shuttle valve piston 182 is movable in an upward direction illustrated by arrow 210 and a downward direction illustrated by arrow 212. The terms upward and downward as used herein are meant to be relative directions and are not intended to be absolute directional orientation. When the shuttle valve piston 182 is in the second position, compressed fluid flows through the inlet 220 around the piston shuttle valve stem 186 and through the outlet 230 as illustrated by arrow 231. A portion of the compressed fluid is directed from the outlet 230 to a working cavity fluid passageway 232 and into a fluid working cavity 233 formed in the lubricator valve 174 to actuate the lubricator valve 174 and cause lubricant to be injected into the compressor fluid stream as will be explained in detail below.

A lubricator valve piston 250 disposed within the lubricator valve 174, is movable between a first position shown in FIG. 4 and second position shown in FIG. 3 in opposing directions as represented by double arrow 251. The lubricator valve piston 250 includes a lubricator valve head 252 connected to a lubricator valve stem 254 at a first end 256 thereof. The lubricator valve stem 254 extends from the first end 256 to a second distal end 258 opposite of the lubricator valve head 252. A lubricator valve resilient member 260 such as a coil spring or the like can be operably coupled with the lubricator valve piston 250 so as to urge the lubricator valve piston 250 toward the first position as illustrated in FIG. 4. When the compressed fluid is permitted to flow through the shuttle valve 172, a portion of the compressed air will traverse through the working cavity fluid passageway 232 and into the fluid working cavity 233 to urge the lubricator piston 250 via pressure force towards the second position as shown in FIG. 3. One or more fluid seals 262 can be operably coupled with lubricator valve head 252 to form a fluid tight seal between the head 252 and internal side walls 263 of the lubricator valve 174 to prevent pressurized fluid from leaking out of the working cavity 233. Likewise, one or more fluid seals 264 can be operably coupled with the lubricator valve piston 250 proximate the distal end 258 of the lubricator valve stem 254. The one or more fluid seals 264 provide a fluid tight seal between the lubricator valve stem 254 and the internal side walls 263 of the lubricator valve 174 to prevent leakage of lubricant from the lubricant reservoir 176.

The lubricator valve 174 includes a lubricant inlet passageway 270 that extends between the lubricant reservoir 176 and a lubricant holding cavity 272 formed by a space between the housing 170 and the distal end 258 of the lubricator valve piston stem 254. When the lubricator valve piston 250 is in the first position as shown in FIG. 4, lubricant can be injected from the lubricant reservoir 176 into the lubricant holding cavity 272 through the inlet passageway 270. In some embodiment the lubricant reservoir may be pressurized to urge lubricant flow through the lubricant inlet passageway 270. In other embodiments, the lubricant flow may be at least partially gravity induced. When the lubricator valve piston 250 is moved toward the second position as shown in FIG. 3, the inlet passageway 270 is closed off by the stem 254 and the lubricant in the holding cavity 272 is forced to flow through a stem passage 274 towards an outlet port 276 formed within the lubricator piston 250 in a fluidly connected association with the stem passage 274. In some forms the stem passage 274 may extend directly to an outlet without a separately formed outlet port 276 as illustrated in the exemplary embodiment.

A lubricant injection port 278 is formed through a wall of the housing 170 between the lubricator valve 174 and the shuttle valve 172. When the outlet port 276 of the lubricator valve piston 250 moves to a corresponding position overlapping at least a portion of the lubricant injection port 278, lubricant will flow from the lubricant holding cavity 272 through the stem passage 274 to the lubricant injection port 278 and is subsequently discharged into the fluid outlet 230 of the shuttle valve 172. In this manner a predefined amount of lubricant is injected into the compressed fluid so that the mixture of working fluid and lubricant can both rotate and lubricate the engine starter 50.

In operation the engine starter system 10 is configured to provide compressed working fluid such as air at a desired temperature and pressure to an engine starter 50 for starting an engine 60. The engine starter system can be used in any industrial application including, but not limited to manufacturing, process industries, refineries, power plants, mining, operations and material handling, etc.

The combination shuttle and lubricator valve 40 is operable to deliver a mixture of compressed fluid and lubricant to the engine air starter 50. The system is initiated when a signal fluid (not shown) is introduced into the cylinder cavity 181 through the signal air inlet 180 of the shuttle valve 172. The signal fluid is provided with a pressure sufficient to move the shuttle valve piston 182 from a closed position to an open position by overcoming the force of the resilient member 200. Compressed fluid can then enter the inlet 220 of the shuttle valve 172 and flow past the shuttle valve piston 182 and out the outlet 230 of the shuttle valve 172. A portion of the compressed air flowing through the outlet 230 is bled off and transported through the working fluid cavity passageway 232 and into the fluid working cavity 233 of the lubricator valve 174. The pressure force of the pressurized fluid acting on the lubricator valve piston head 252 is operable to move the lubricator valve piston 250 from the first position to the second position against the force of the spring 260. When the lubricator valve piston 250 is moved from the first to second position, the lubricant that is stored in the lubricant holding cavity 272 is forced to flow through the stem passageway 274 of the lubricator valve piston 250 and flow into the compressed fluid flow stream in the outlet 230 when injected through the lubricator injection port 278.

When the signal air is shut off to the shuttle valve 172, the shuttle valve piston 182 will move back to the first position and shut off the fluid flowpath from the inlet 220 to the outlet 230. The pressure of the fluid working cavity 233 will then bleed back out of the fluid working cavity passageway 232 which permits the resilient member 260 of the lubricator valve 174 to force the lubricator valve piston 250 back to the first position. When the lubricator valve 250 is in the first position, the lubricant inlet passageway 270 is open so that the lubricant holding cavity 272 can be refilled and primed for lubricant injection prior to the next engine start.

In one aspect, the present disclosure includes a system comprising: a source of compressed working fluid; a combination valve in fluid communication with the compressed working fluid, the combination valve including: a housing; a shuttle valve positioned within the housing; a lubricator valve positioned within the housing, the lubricator valve being in selective fluid communication with the shuttle valve; and a lubricant reservoir positioned within the housing, the lubricant reservoir being in selective fluid communication with the lubricator valve; a lubricant inlet passageway formed through a first wall of the housing between the lubricator valve and the lubricant reservoir; and a lubricant injection port formed through a second wall of the housing between the lubricator valve and the shuttle valve.

In refining aspects, the shuttle valve further comprises a support base extending inward from a third wall of the housing; a shuttle valve piston having a stem extending between a head at one end and a foot at the other end, the shuttle piston movable between first and second positions, wherein the first position corresponds to closed position and the second position corresponds to an open position; and an extension projecting from the foot configured to slidingly engage with the support base; a fluid inlet in fluid communication with the source of compressed fluid; and a fluid outlet downstream of the shuttle valve piston; a resilient member operably engaged with the shuttle piston and the support base; wherein the resilient member urges the shuttle piston to the closed position; a first seal connectable to the head and a second seal connectable to the foot of the shuttle valve piston; a signal fluid inlet port in fluid communication with a cylinder cavity formed therein; wherein signal fluid is directed through the signal fluid inlet port to move a shuttle piston from a closed position to an open position; wherein the lubricator valve includes a lubricator valve piston movable between first and second positions, the lubricator valve piston having a stem extending from a valve head to a distal end; and a stem passageway extending through the stem from the distal end to an outlet port formed in the lubricator valve piston; wherein the lubricator valve further includes a lubricant holding cavity between the distal end of the stem and a fourth wall of the housing; a fluid working cavity formed between the head of the lubricator valve piston and a fifth wall of the housing; and a fluid working cavity passageway formed through a sixth wall of the housing between the fluid working cavity and the shuttle valve; wherein the lubricant inlet passageway is open to the lubricant holding cavity when the lubricator valve piston is in the first position and the lubricant inlet passageway is closed when the lubricator valve piston is in the second position; a lubricator valve resilient member operably connected to the lubricator valve piston; wherein the lubricator valve resilient member urges the lubricator valve piston toward the first position and pressurized fluid delivered to the working fluid cavity from the shuttle valve urges the lubricator valve piston toward the second position; wherein lubricant is displaced from the lubricant holding cavity, transported through the lubricator valve piston stem passageway and discharged into a fluid outlet of the shuttle valve when the lubricator valve moves from the first position to the second position; further comprising an engine air starter positioned downstream of the combination valve, the engine air starter valve operable to receive a mixture of compressed fluid and lubricant from the combination valve.

In another aspect, the present disclosure includes a combination valve comprising: a housing having shuttle valve and a lubricator valve disposed therein; a fluid working cavity passageway formed through a first wall of the housing between the lubricator valve and the shuttle valve; a lubricant injection port formed through the first wall of the housing between the lubricator valve and the shuttle valve; a lubricator valve piston having a stem extending between first and second ends, a piston head positioned adjacent the first end and a stem passageway extending from the second end toward the first end, and a lubricant outlet port fluidly connected to the stem passageway; a fluid working cavity located in the lubricator valve between the head of the lubricator valve piston and a second wall of the housing; a lubricant holding cavity located between the second end of the stem and a third wall of the housing; and a shuttle valve piston positioned between a fluid inlet and a fluid outlet of the shuttle valve.

In refining aspects, the shuttle valve piston and the lubricator valve piston are each movable between first and second positions; wherein compressed fluid is free to flow through the fluid outlet of the shuttle valve and a portion of the compressed fluid is directed into the fluid working cavity of the lubricator valve when the shuttle valve piston is in the second position; wherein the lubricator valve piston moves from the first position toward the second position when the compressed fluid is directed into the fluid working cavity; wherein the lubricant is injected through the stem passageway and into the fluid outlet of the shuttle valve when the lubricator valve piston is moved from the first to the second position; further comprising at least one seal configured to seal between the housing and each of the lubricator valve and shuttle valve pistons; at least one spring engaged between the housing and each of the lubricator valve and shuttle valve pistons; a lubricant reservoir disposed within the housing; a lubricant inlet port formed through a fourth wall of the housing between the lubricant reservoir and the lubricant holding cavity in the lubricator valve; wherein the lubricant inlet port is open and the lubricant injection port is closed when the lubricator valve piston is in a first position; and the lubricant inlet port is closed and the lubricant injection port is open when the lubricator valve piston is in a second position.

In another aspect, the present disclosure includes a method comprising: flowing compressed fluid to a compressed fluid inlet of a shuttle valve; moving a shuttle valve piston from a first position to a second position; flowing compressed fluid past the shuttle valve piston in the second position to a compressed fluid outlet; bleeding off a portion of the compressed fluid at the compressed fluid outlet, wherein the bleeding includes transporting a portion of the compressed fluid to a working cavity within a lubricator valve through a fluid working cavity passage formed in a wall between the shuttle valve and the lubricator valve; moving a lubricator valve piston from a first position to a second position; injecting lubricant from a holding cavity within the lubricator valve into the compressed fluid flowing through the compressed fluid outlet when the lubricator valve piston is moved to the second position; and re-supplying lubricant to the lubricant holding cavity from a lubricant reservoir when the lubricator valve is moved from the second position to the first position.

In refining aspects, the moving of the shuttle valve piston includes a first resilient member to urge the shuttle valve piston toward the first position and a signal fluid flow to urge the shuttle valve piston toward the second position; wherein the moving of the lubricator valve piston includes a second resilient member to urge the lubricator valve piston toward the first position and pressurized fluid in the working cavity urges the lubricator valve piston toward the second position; wherein the lubricator valve piston opens a first passageway between the lubricant reservoir and the holding cavity and closes a second passageway between the holding cavity and the compressed fluid outlet of the shuttle valve when the lubricator valve piston is moved to the first position; and wherein the lubricator valve piston closes the first passageway and opens the second passageway when the lubricator valve piston is moved to the second position.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A system comprising:

a source of compressed working fluid;

a combination valve in fluid communication with the compressed working fluid, the combination valve including:

a housing;

a shuttle valve positioned within the housing; the shuttle valve comprises a signal fluid inlet port in fluid communication with a cylinder cavity formed within the housing;

a lubricator valve positioned within the housing, the lubricator valve being in selective fluid communication with the shuttle valve; and a lubricant reservoir positioned within the housing, the lubricant reservoir being in selective fluid communication with the lubricator valve;

a lubricant inlet passageway formed through a first wall of the housing between the lubricator valve and the lubricant reservoir; and a lubricant injection port formed through a second wall of the housing between the lubricator valve and the shuttle valve.

2. The system of claim 1, wherein the shuttle valve further comprises a support base extending inward from a third wall of the housing.

3. The system of claim 2, wherein the shuttle valve further includes:

a shuttle valve piston having a stem extending between a head at one end and a foot at the other end, the shuttle valve piston movable between first and second positions, wherein the first position corresponds to closed position and the second position corresponds to an open position; and an extension projecting from the foot configured to slidingly engage with the support base.

4. The system of claim 3, wherein the shuttle valve further comprises:

a fluid inlet in fluid communication with the source of compressed fluid; and a fluid outlet downstream of the shuttle valve piston.

5. The system of claim 3, wherein the shuttle valve further comprises a resilient member operably engaged with the shuttle piston and the support base.

6. The system of claim 5, wherein the resilient member urges the shuttle piston to the closed position.

7. The system of claim 3, further comprising a first seal connectable to the head and a second seal connectable to the foot of the shuttle valve piston.

8. The system of claim 1, wherein signal fluid is directed through the signal fluid inlet port to move a shuttle piston from a closed position to an open position.

9. The system of claim 1, wherein the lubricator valve includes:

a lubricator valve piston movable between first and second positions, the lubricator valve piston having a stem extending from a valve head to a distal end; and a stem passageway extending through the stem from the distal end to an outlet port formed in the lubricator valve piston.

10. The system of claim 9, wherein the lubricator valve further includes:

a lubricant holding cavity between the distal end of the stem and a fourth wall of the housing;

a fluid working cavity formed between the head of the lubricator valve piston and a fifth wall of the housing; and a fluid working cavity passageway formed through a sixth wall of the housing between the fluid working cavity and the shuttle valve.

11. The system of claim 10, wherein the lubricant inlet passageway is open to the lubricant holding cavity when the lubricator valve piston is in the first position and the lubricant inlet passageway is closed when the lubricator valve piston is in the second position.

12. The system of claim 10, further comprising a lubricator valve resilient member operably connected to the lubricator valve piston.

13. The system of claim 12, wherein the lubricator valve resilient member urges the lubricator valve piston toward the first position and pressurized fluid delivered to the working fluid cavity from the shuttle valve urges the lubricator valve piston toward the second position.

14. The system of claim 10, wherein lubricant is displaced from the lubricant holding cavity, transported through the lubricator valve piston stem passageway and discharged into a fluid outlet of the shuttle valve when the lubricator valve moves from the first position to the second position.

15. The system of claim 1, further comprising an engine air starter positioned downstream of the combination valve, the engine air starter valve operable to receive a mixture of compressed fluid and lubricant from the combination valve.

16. A combination valve comprising:

a housing having shuttle valve and a lubricator valve disposed therein;

a fluid working cavity passageway formed through a first wall of the housing between the lubricator valve and the shuttle valve;

a lubricant injection port formed through the first wall of the housing between the lubricator valve and the shuttle valve;

a lubricator valve piston having a stem extending between first and second ends, a piston head positioned adjacent the first end and a stem passageway extending from the second end toward the first end, and a lubricant outlet port fluidly connected to the stem passageway;

a fluid working cavity located in the lubricator valve between the head of the lubricator valve piston and a second wall of the housing;

a lubricant holding cavity located between the second end of the stem and a third wall of the housing; and a shuttle valve piston positioned between a fluid inlet and a fluid outlet of the shuttle valve.

17. The combination valve of claim 16, wherein the shuttle valve piston and the lubricator valve piston are each movable between first and second positions.

18. The combination valve of claim 17, wherein compressed fluid is free to flow though the fluid outlet of the shuttle valve and a portion of the compressed fluid is directed into the fluid working cavity of the lubricator valve when the shuttle valve piston is in the second position.

19. The combination valve of claim 18, wherein the lubricator valve piston moves from the first position toward the second position when the compressed fluid is directed into the fluid working cavity.

20. The combination valve of claim 17, wherein lubricant is injected through the stem passageway and into the fluid outlet of the shuttle valve when the lubricator valve piston is moved from the first to the second position.

21. The combination valve of claim 16, further comprising at least one seal configured to seal between the housing and each of the lubricator valve and shuttle valve pistons.

22. The combination valve of claim 16, further comprising at least one spring engaged between the housing and each of the lubricator valve and shuttle valve pistons.

23. The combination valve of claim 16, further comprising a lubricant reservoir disposed within the housing.

24. The combination valve of claim 23, further comprising a lubricant inlet port formed through a fourth wall of the housing between the lubricant reservoir and the lubricant holding cavity in the lubricator valve.

25. The combination valve of claim 24, wherein the lubricant inlet port is open and the lubricant injection port is closed when the lubricator valve piston is in a first position; and the lubricant inlet port is closed and the lubricant injection port is open when the lubricator valve piston is in a second position.

26. A method comprising:

flowing compressed fluid to a compressed fluid inlet of a shuttle valve;

moving a shuttle valve piston from a first position to a second position;

flowing compressed fluid past the shuttle valve piston in the second position to a compressed fluid outlet;

bleeding off a portion of the compressed fluid at the compressed fluid outlet, wherein the bleeding includes transporting a portion of the compressed fluid to a working cavity within a lubricator valve through a fluid working cavity passage formed in a wall between the shuttle valve and the lubricator valve;

moving a lubricator valve piston from a first position to a second position;

injecting lubricant from a holding cavity within the lubricator valve into the compressed fluid flowing through the compressed fluid outlet when the lubricator valve piston is moved to the second position; and re-supplying lubricant to the lubricant holding cavity from a lubricant reservoir when the lubricator valve is moved from the second position to the first position.

27. The method of claim 26, wherein the moving of the shuttle valve piston includes a first resilient member to urge the shuttle valve piston toward the first position and a signal fluid flow to urge the shuttle valve piston toward the second position.

28. The method of claim 26, wherein the moving of the lubricator valve piston includes a second resilient member to urge the lubricator valve piston toward the first position and pressurized fluid in the working cavity urges the lubricator valve piston toward the second position.

29. The method of claim 26, wherein the lubricator valve piston opens a first passageway between the lubricant reservoir and the holding cavity and closes a second passageway between the holding cavity and the compressed fluid outlet of the shuttle valve when the lubricator valve piston is moved to the first position; and wherein the lubricator valve piston closes the first passageway and opens the second passageway when the lubricator valve piston is moved to the second position.

* * * * *